US006497495B1

(12) United States Patent
Janz

(10) Patent No.: US 6,497,495 B1
(45) Date of Patent: Dec. 24, 2002

(54) METHOD AND APPARATUS FOR A SELF-CONTAINED ILLUMINATION DEVICE DETACHABLY COUPLED TO A TOY

(76) Inventor: James R. Janz, 95 Wilburn Ave., Atherton, CA (US) 94027

( * ) Notice: Subject to any disclaimer, the term of this patent is extended or adjusted under 35 U.S.C. 154(b) by 0 days.

(21) Appl. No.: 09/834,358

(22) Filed: Apr. 12, 2001

(51) Int. Cl.[7] ..... F21L 4/00

(52) U.S. Cl. ..... 362/194; 362/191; 362/203; 362/396; 362/802; 362/800; 446/485

(58) Field of Search ..... 362/190, 191, 362/203, 194, 396, 276, 802, 800; 446/485

(56) References Cited

U.S. PATENT DOCUMENTS 4,599,682 A * 7/1986 Stephens ..... 362/103
4,970,631 A * 11/1990 Marshall ..... 362/105
6,132,060 A * 10/2000 Gallo ..... 362/190
6,224,235 B1 * 5/2001 Parker ..... 362/190
6,315,425 B1 * 11/2001 Confrey ..... 362/86

* cited by examiner

*Primary Examiner*—Alan Cariaso
*Assistant Examiner*—Sharon Payne
(74) *Attorney, Agent, or Firm*—Blakely, Sokoloff, Taylor & Zafman LLP

(57) ABSTRACT

A method and an apparatus for a self-contained illumination device that couples to a toy are given. The self-contained illumination device comprises a first housing containing a battery, a middle housing coupled to a light emitting body, and a second housing having an aperture. The second housing is detachably attached to the middle housing such that the light emitting body fits through the aperture on the second housing. The second housing moves from a non-illuminating position to an illuminating position such that the light emitting body contacts the battery when the second housing is in the illuminating position. A connection device attached to the first housing detachably couples to a toy.

28 Claims, 4 Drawing Sheets

METHOD AND APPARATUS FOR A SELF-CONTAINED ILLUMINATION DEVICE DETACHABLY COUPLED TO A TOY

FIELD OF THE INVENTION

The present invention relates generally to toys, and particularly, to a self-contained illumination device that detachably couples to a toy.

BACKGROUND OF THE INVENTION

Presently, there are illumination devices having a battery and a light emitting diode. These illumination devices may be attached to a variety of objects such as shoes, cloths, jewelry and watches. In addition, there are a wide variety of toys such as trucks and dolls that also have light sources that emit light. Some of these toys use a battery coupled with a light source. Other toys that emit light use another power source such as a power outlet connected to a cord in order to power a light source on the toy.

There are presently no illumination devices that are self-contained and configured to be readily attached and detached from a variety of toys. Currently, toys that emit light from a light source on the toy have the light source permanently affixed to the toy. One example may be a toy truck with an illuminating headlight. The illuminating headlight is actually a permanent fixture of the toy truck. The illuminating headlight is neither self-contained nor detachable from the toy truck. This severely limits the application of the illumination device.

In the case of specific types of toys that require versatility, a detachable self-contained light is needed. For example, such toys as LEGO™ building sets and CONNEX™ building sets are a type of toy having well-known components specifically configured to interconnect in which different structures are created each time. In the case of these types of toys, it is desirable to have a versatile self-contained illuminating device configured to couple to different types of toys. It is also desirable to have a self-contained illumination device that may detachably couple to each new structure built using LEGO™ and/or CONNEX™ building sets.

SUMMARY OF THE INVENTION

Accordingly, the present invention is a self-contained illumination device that couples to a toy. The self-contained illumination device comprises a first housing containing a battery, a middle housing attached to a light emitting body, and a second housing having an aperture. The second housing is detachably attached to the middle housing such that the light emitting body fits through the aperture on the second housing. The second housing moves from a non-illuminating position to an illuminating position such that the light emitting body contacts the battery when the second housing is in the illuminating position. A connection device attached to the first housing detachably couples to a toy.

BRIEF DESCRIPTION OF THE DRAWINGS

The present invention is illustrated by way of example, and not limitation, in the figures of the accompanying drawings in which.

DETAILED DESCRIPTION

A method and an apparatus for a self-contained illumination device that couples to a toy are disclosed. In the following detailed description, numerous specific details are set forth in order to provide a more thorough understanding of the invention. However, it will be apparent to one of ordinary skill in the art that these specific details need not be used to practice the present invention. In other circumstances, other well-known structures, materials, circuits, processes, and interfaces have not been shown or described in detail in order not to unnecessarily obscure the present invention.

Figure 1:
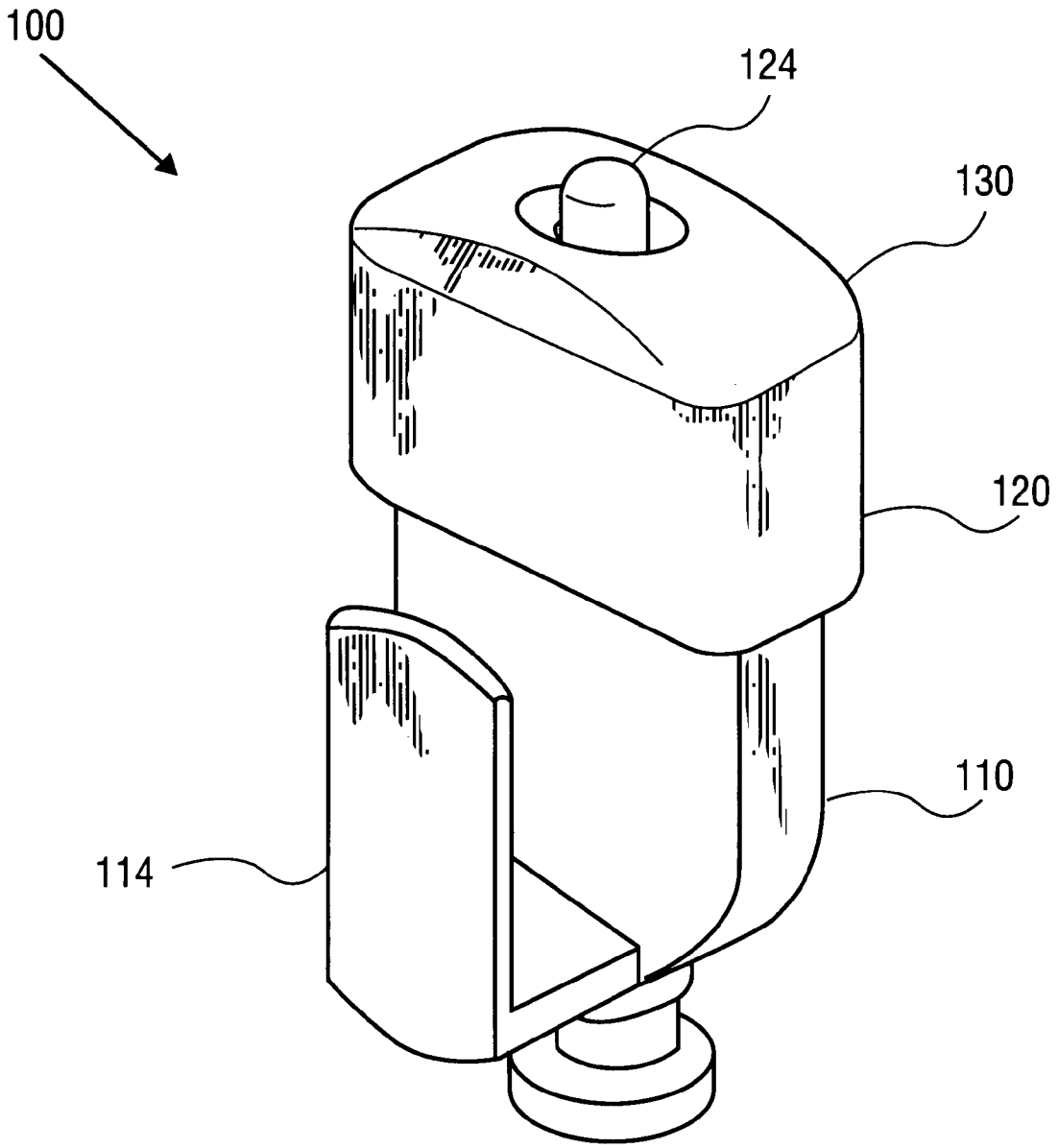
FIG. 1 is a perspective view of one embodiment of the invention.

FIG. 1 shows one embodiment of a self-contained illumination device 100 that detachably couples to a toy. The self-contained illumination device 100 comprises a first housing 110, a middle housing 120 having a light emitting body 124 attached to it, and a second housing 130. The first housing 110 also includes a connection assembly 114 that couples the device to a toy.

Figure 2:
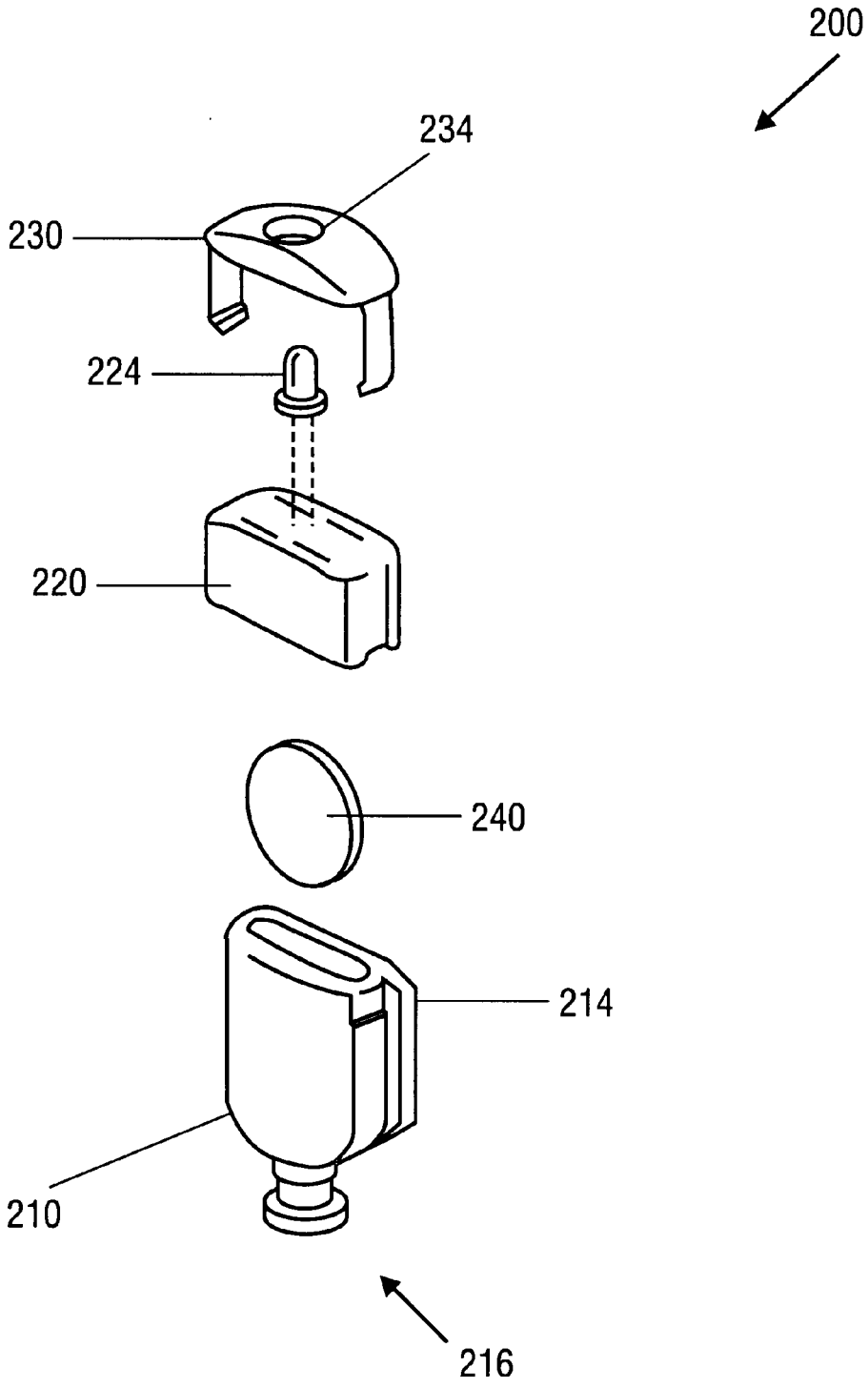
FIG. 2 is an exploded perspective view of one embodiment of the invention.

In FIG. 2, an exploded view may be seen of the embodiment shown in FIG. 1. The first housing 210 contains the battery 240. In addition, the second housing 230 has an aperture 234. In one embodiment, the second housing 230 is detachably attached to a middle housing 220 such that the light emitting body 224 fits through the aperture on the second housing. Once the first housing 210 is coupled to the middle housing 220, the second housing 230 moves from a non-illuminating position to an illuminating position such that the light emitting body 224 contacts the battery 240 when the second housing 230 is in the illuminating position. Thus, the illumination device is self-contained in that the battery 240 and the light emitting body 224 are housed in one device and may be coupled separately to any given toy. A user may push down on the second housing 230 to snap it into place with the middle housing 220 in order for the light emitting body 224 to emit light. In one embodiment, the light emitting body 224 is a light emitting diode. The first housing 210 includes a connection assembly 214 that couples the device to a toy.

In the embodiment shown in FIGS. 1 and 2, the connection assembly 214 is a clip that is attached to the first housing 210. In one embodiment, the clip is detachably attached to the first housing 210. In an alternative embodiment, the clip is permanently attached to the first housing 210. This clip allows the self-contained illumination device 200 to clip on to any number of toys. In alternative embodiments, however, many different types of connection assemblies may be used. In one embodiment, the connection assembly may be a VELCRO™ assembly that allows the self-contained illumination device to couple itself to a toy. In an alternative embodiment, the connection assembly may be a self-adhesive strip that allows the device to be coupled to the toy. Although, the connection assembly is shown to be a clip in FIGS. 1 and 2, this is not the only embodiment of the connection assembly.

Figure 3:
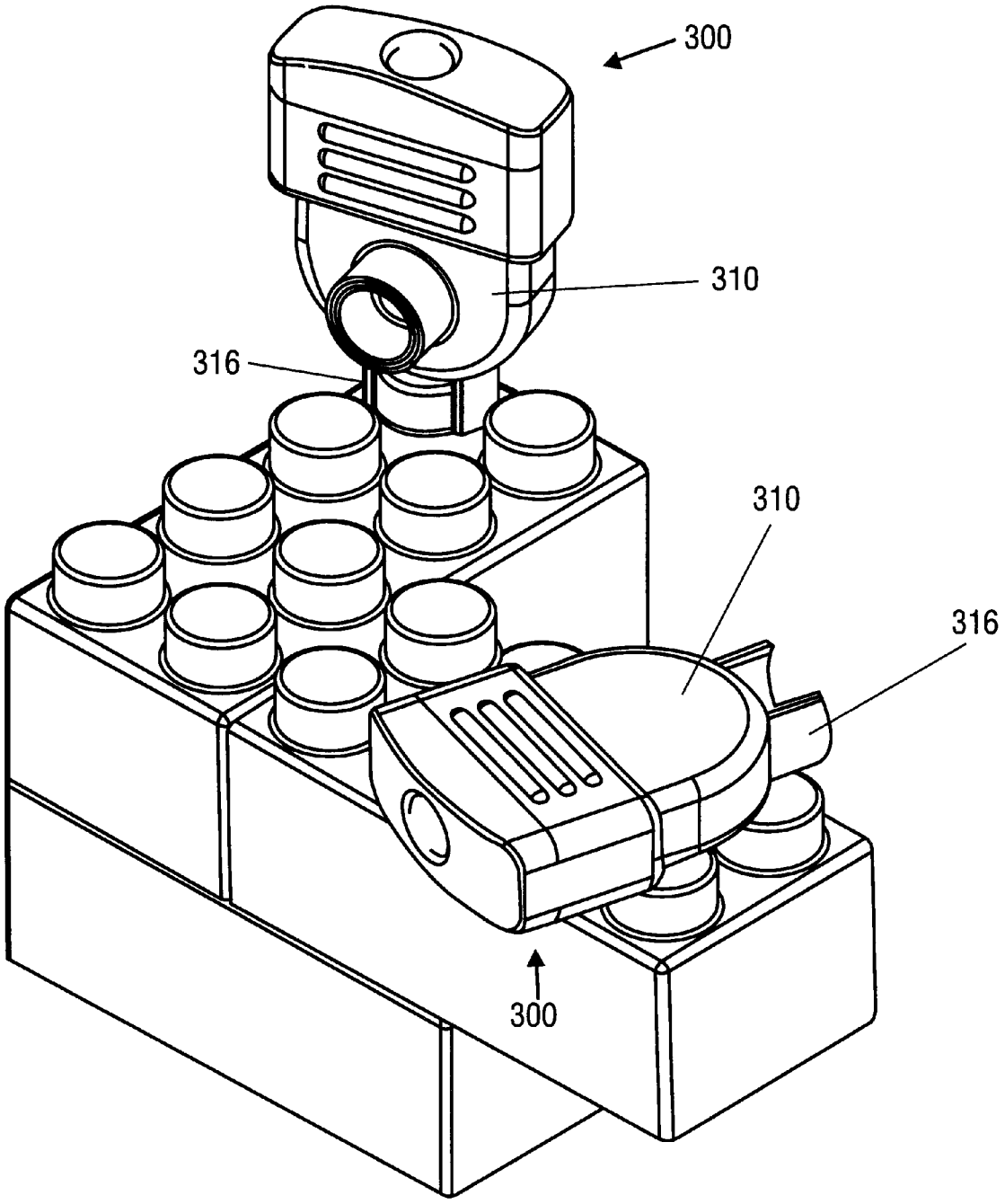
FIG. 3 is a view of one embodiment of the invention with a second connection assembly.

In the embodiment shown in FIG. 2, the first housing 210 also has a second connection assembly 216. FIG. 3 is one embodiment of the invention with a second connection assembly 316. In FIG. 3, the second connection assembly 316 is specifically configured to be able to couple the self-contained illumination device 300 to a LEGO™ assembly. This second connection assembly 316 may be manufactured to be permanently attached to the first housing 310.

In an alternative embodiment, the second connection assembly 316 may be manufactured to be detachably attached to the first housing 316. The self-contained illumination device 300 may be coupled and then easily detached from the LEGO™ assembly. As LEGOS™ are rearranged in different assembly structures, the self-contained illumination device is versatile in coupling to one LEGOS™ assembly and then coupling to another LEGOS™ assembly. In addition, since the illumination device 300 is self-contained and independently powered by a battery, this versatility is possible.

Figure 4:
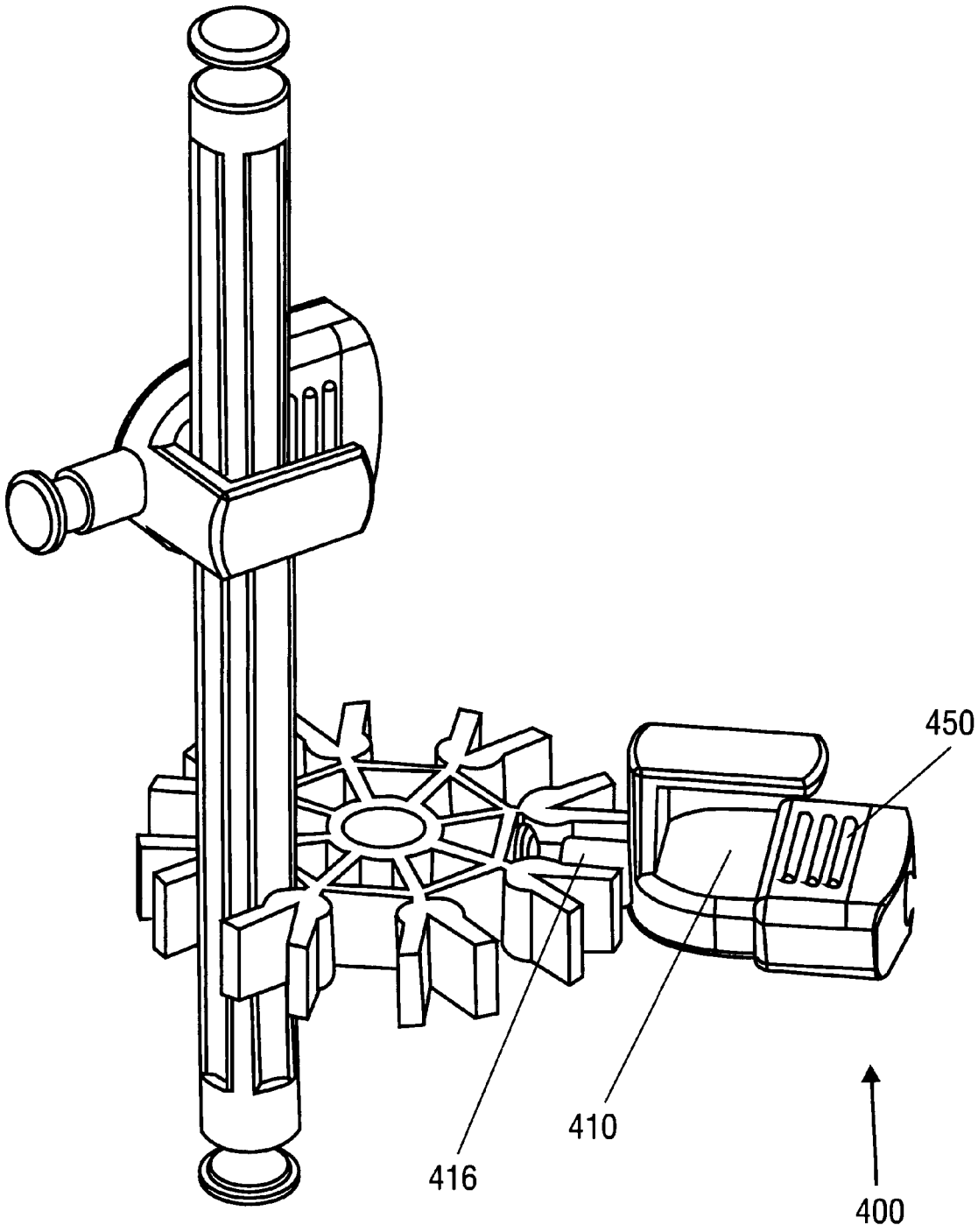
FIG. 4 is a view of an alternative embodiment of the invention with a second connection assembly.

FIG. 4 is an alternative embodiment of the invention with a second connection assembly 416. In FIG. 4, the second connection assembly 416 is specifically configured to be able to couple the self-contained illumination device 400 to a CONNEX™ assembly. This second connection assembly 416 may be manufactured to be permanently attached to the first housing 410. In an alternative embodiment, the second connection assembly 416 may be manufactured to be detachably attached to the first housing 416. In FIG. 4, the self-contained illumination device 400 may be coupled and then easily detached from the CONNEX™ assembly. As CONNEX™ are rearranged in different assembly structures, the self-contained illumination device is versatile in coupling to one CONNEX™ assembly and then coupling to another CONNEX™ assembly. In addition, since the illumination device 400 is self-contained and independently powered by a battery, this versatility is possible.

In other embodiments, the self-contained illumination device may also include an activation switch 450 as shown in FIG. 4. Rather than having the movement of the second housing relative to the middle housing connect the battery to the light emitting body, an activation switch 450 can connect the battery to the light emitting body. When a user activates the activation switch 450, the connection is established between the battery and the light emitting body causing the light emitting body to emit light. In an alternative embodiment, a user can operate the activation switch 450 from a distance using a remote controller.

Thus, a method and apparatus for a self-contained illumination device that couples to a toy are disclosed. Although the present invention is described herein with reference to a specific embodiment, many modifications and variations therein will readily occur to those with ordinary skill in the art. Accordingly, all such variations and modifications are included within the intended scope of the present invention as defined by the following claims.

What is claimed is:

1. A self-contained illumination device that detachably couples to toys comprising:

a first housing holding a battery;

a middle housing detachably attached to the first housing, the middle housing coupled to a light emitting body;

a second housing having an aperture, the second housing detachably attached to the middle housing such that the light emitting body fits through the aperture on the second housing, and the second housing moving from a non-illuminating position to an illuminating position such that the light emitting body contacts the battery when the second housing is in the illuminating position; and a first connection assembly attached to the first housing, the first connection assembly detachably coupling to a toy.

2. The device of claim 1 wherein the first housing includes a second connection assembly configured so that the second connection assembly can be detachably coupled to a specific type of toy assembly.

3. The device of claim 2 wherein the second connection assembly is detachably attached to the first housing.

4. The device of claim 1 wherein the first connection assembly is detachably attached to the first housing.

5. The device of claim 1 wherein the first connection assembly is a clip assembly used to couple the self-contained illumination device to the toy.

6. The device of claim 1 wherein the light emitting body is a light emitting diode.

7. A self-contained illumination device that detachably couples to toys comprising:

a first housing holding a battery;

a middle housing detachably attached to the first housing, the middle housing coupled to a light emitting body;

a second housing having an aperture, the second housing detachably attached to the middle housing such that the light emitting body fits through the aperture on the second housing, the second housing moving from a non-illuminating position to an illuminating position such that the light emitting body contacts the battery when the second housing is in the illuminating position;

a first connection assembly attached to the first housing, the first connection assembly detachably coupling to a toy; and a second connection assembly attached to the first housing, the second connection assembly configured to detachably couple to a specific type of toy assembly.

8. A self-contained illumination device that detachably couples to a toy comprising:

a first housing containing a battery;

a middle housing detachably attached to the first housing, the middle housing coupled to a light emitting body;

a second housing detachably attached to the middle housing;

an activation switch that allows a user to establish a connection between the light emitting body and the battery such that the light emitting body emits light when in contact with the battery; and a first connection assembly attached to the first housing, the connection assembly detachably coupling to a toy.

9. The device of claim 8 wherein the first housing includes a second connection assembly configured so that the second connection assembly can be detachably coupled to a specific type of toy assembly.

10. The device of claim 9 wherein the second connection assembly is detachably attached to the first housing.

11. The device of claim 8 wherein the first connection assembly is detachably attached to the first housing.

12. The device of claim 8 wherein the first connection assembly is a clip assembly used to couple the self-contained illumination device to the toy.

13. The device of claim 8 wherein the light emitting body is a light emitting diode.

14. A self-contained illumination device that detachably couples to toys comprising:

a first housing containing a battery;

a middle housing detachably attached to the first housing, the middle housing coupled to a light emitting body;

a second housing detachably attached to the middle housing;

an activation switch that allows a user to establish a connection between the light emitting body and the battery such that the light emitting body emits light when in contact with the battery;

a first connection assembly attached to the first housing, the first connection assembly detachably coupling to a toy; and a second connection assembly attached to the first housing, the second connection assembly configured to detachably couple to a specific type of toy assembly.

15. A method of coupling a self-contained illuminating device to a toy comprising:

coupling a first connection assembly located on a first housing of the self-contained illuminating device to the toy so that the self-contained illuminating device can be attached and detached from the toy at any time; and establishing a connection between a light emitting body and a battery, the light emitting body attached to a middle housing and the battery contained in the first housing, the connection causing the light emitting body to. emit light when the light emitting body comes in contact with the battery.

16. The method of claim 15 wherein establishing a connection between the light emitting body and the battery includes moving a second housing relative to the middle housing, the second housing moving from a non-illuminating position to an illuminating position such that the light emitting body contacts the battery when the second housing is in the illuminating position.

17. The method of claim 15 further comprising coupling a second connection assembly to a specific type of toy assembly, the second connection assembly coupled to the first housing and configured to be detachably coupled to the specific type of toy assembly.

18. The method of claim 15 further comprising coupling a second connection assembly to a specific type of toy assembly, the second connection assembly detachably coupled to the first housing and configured to be detachably coupled to the specific type of toy assembly.

19. The method of claim 8 wherein the first connection assembly is detachably attached to the first housing.

20. The method of claim 15 wherein the first connection assembly is a clip assembly used to couple the self-contained illumination device to the toy.

21. The method of claim 8 wherein the light emitting body is a light emitting diode.

22. A method of coupling a self-contained illuminating device to a toy comprising:

coupling a first connection assembly located on the self-contained illuminating device to the toy such that the self-contained illuminating device can be attached and detached from the toy at any time; and establishing a connection between a light emitting body and a battery, the light emitting body attached to a middle housing and the battery contained in a first housing, the connection causing the light emitting body to emit light when the light emitting body comes in contact with the battery.

23. The method of claim 22 wherein establishing a connection between the light emitting body and the battery includes causing an activation switch located on said self-contained illuminating device to establish the connection between a light emitting body and a battery.

24. The method of claim 22 further comprising coupling a second connection assembly to a specific type of toy assembly, the second connection assembly coupled to the self-contained illumination device and configured to detachably couple to the specific type of toy assembly.

25. The method of claim 22 further comprising coupling a second connection assembly to a specific type of toy assembly, the second connection assembly detachably coupled to the self-contained illumination device and configured to detachably couple to the specific type of toy assembly.

26. The method of claim 22 wherein the first connection assembly is detachably attached to the first housing.

27. The method of claim 22 wherein the first connection assembly is a clip assembly used to couple the self-contained illumination device to the toy.

28. The method of claim 22 wherein the light emitting body is a light emitting diode.

* * * * *